United States Patent [19]

Thinesen

[11] Patent Number: 5,008,866

[45] Date of Patent: Apr. 16, 1991

[54] ALARM SETTING PROGRAM FOR ALARM TIMEPIECE WITH ALTERNATE TIME ZONE

[75] Inventor: Tom Thinesen, San Jose, Calif.

[73] Assignee: Timex Corporation, Middlebury, Conn.

[21] Appl. No.: 466,101

[22] Filed: Jan. 16, 1990

[51] Int. Cl.[5] ..... G04B 19/22

[52] U.S. Cl. ..... 368/21; 368/74

[58] Field of Search ..... 368/21, 22, 12, 72, 368/73, 246, 261

[56] References Cited

U.S. PATENT DOCUMENTS 4,274,151 6/1981 Kamiwaki ..... 368/21

*Primary Examiner*—Bernard Roskoski

*Attorney, Agent, or Firm*—William C. Crutcher

[57] ABSTRACT

A multimode electronic timepiece includes a display, an audible alarm device, a plurality of manually actuated switches, and an integrated circuit programmed to keep time and to provide a plurality of modes including time-of-day, alternate time zone and alarm setting modes. The integrated circuit is programmed to permit an operator to set time-of-day in response to actuation of selected switches, to set alternate time zone time in response to actuation of selected switches, and to set alarm set time in response to actuation of selected switches. The integrated circuit has a memory location for time-of-day and is programmed to selectively actuate the audible alarm device when the alarm set time corresponds to time-of-day in said memory location. The improvement comprises a flag selected in response to actuation of one of the switches which will substitute the alternate time zone time for time-of-day, whereby the audible alarm device may be selectively actuated when the alarm set time corresponds either to time-of-day or to alternate time zone time, depending upon setting of the flag.

4 Claims, 5 Drawing Sheets

ALARM SETTING PROGRAM FOR ALARM TIMEPIECE WITH ALTERNATE TIME ZONE

BACKGROUND OF THE INVENTION

This invention relates generally to multimode electronic timepieces with an alarm mode and an alternate time zone mode. More particularly, the invention relates to an improved program for setting the alarm time in an electronic wristwatch having Provision for an alternate time zone in addition to local time of day.

Multimode, multifunction wristwatches (or wrist instruments) are known which include a display, a lamp for illuminating the display, a number of manually actuated switches and an integrated circuit programmed in a preselected sequence. Examples of such watches are seen in Houlihan et al U.S. Pat. No(s). 4,783,773, 4,780,864 and Horan U.S. Pat. No. 4,283,784, all of the foregoing being assigned to the present assignee. In the foregoing patents, which are merely exemplary of multimode electronic wrist instruments or multifunction wristwatches, one of the manual actuators may typically serve to repetitively cycle the instrument through a number of modes or operating states in each of which a different type of information is displayed. Such modes may include, in a multifunction watch, the time of day, chronograph, dual time zone, elapsed time and an alarm setting mode. By special preselected actuation of one of the switches, the wristwatch may be further converted into a computer, a speedometer, pulsometer or any other type of device, subject only to the imagination of the designer and programmer of the integrated circuit. While in any of these modes, another manual switch actuator may be employed to change the information being displayed in that mode or state, such as initiating the chronograph timing or setting the time-of-day or setting the alarm time or performing a calculation.

A problem existing with alarm wristwatches which also have provision for an alternate time zone, sometimes known as dual time alarm wristwatches, arises from the fact that the alarm setting program is carried out in relation to the primary timekeeping function which is set to the local time of day. Such a watch has a time-of-day (TOD) mode which is set to the user's local time to display hours, minutes, seconds and day/date information on the electro-optical display. By shifting to the alarm mode, a desired alarm time (alarm set time) selected by the user is set by manually actuated switches. The alarm is "armed" by a manually actuated switch and the alarm set time is constantly compared to the TOD. When the two settings coincide, an audible alarm device is actuated. If such a watch is also provided with an alternate time zone, the user may shift to the alternate time zone and display hours, minutes, seconds and calendar information in another time zone. However, the alarm will continue to be actuated in accordance with the local TOD. This will result in the alarm sounding at the wrong time if the user is in the second time zone, which can be a source of annoyance unless suitable adjustments are made. The only way to make the adjustments is to mentally calculate the correction between time zones and set the alarm time "incorrectly" so that it will be actuated at the proper time in the alternate time zone. Another way to make the adjustment is to reset the watch so that the local TOD is correct in the alternate time zone and then set the alarm by reference to the local TOD.

A system or program is needed whereby a user can quickly and easily cause the alarm, once set, to give an audible alarm either in the local TOD or in the alternate time zone. For examPle, if one wishes to set a wake-up time at 6:30 a.m., it would be desirable to have the alarm sound at 6:30 a.m. either in the local TOD or in the alternate time zone as desired without the foregoing need for adjustment or resetting the watch.

Accordingly, one object of the present invention is to provide an improved program for setting the alarm in an alarm timepiece which includes alternate time zones.

Another object of the invention is to provide an improved method for setting a dual time alarm timepiece to provide an alarm which is relative to a selected time zone.

SUMMARY OF THE INVENTION

Briefly stated, the invention comprises an improvement in a multimode electronic timepiece having a display, an audible alarm device, a plurality of manually actuated switches, and an integrated circuit programmed to keep time and to provide a plurality of modes including time-of-day, alternate time zone and alarm setting modes, said integrated circuit being programmed to permit an operator to set time-of-day in response to actuation of selected switches, to set alternate time zone time in response to actuation of selected switches, and to set alarm set time in response to actuation of selected switches, said integrated circuit having a memory location for time-of-day and being programmed to selectively actuate said audible alarm device when said alarm set time corresponds to time-of-day in said memory location, the improvement comprising:

flag means selected in response to actuation of one of said switches adapted to substitute said alternate time zone time instead of time-of-day, whereby said audible alarm device may be actuated when the alarm set time corresponds either to time-of-day or to alternate time zone time depending upon the setting of said flag means.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

DESCRIPTION OF THE PREFERRED EMBODIMENT

Figure 1:
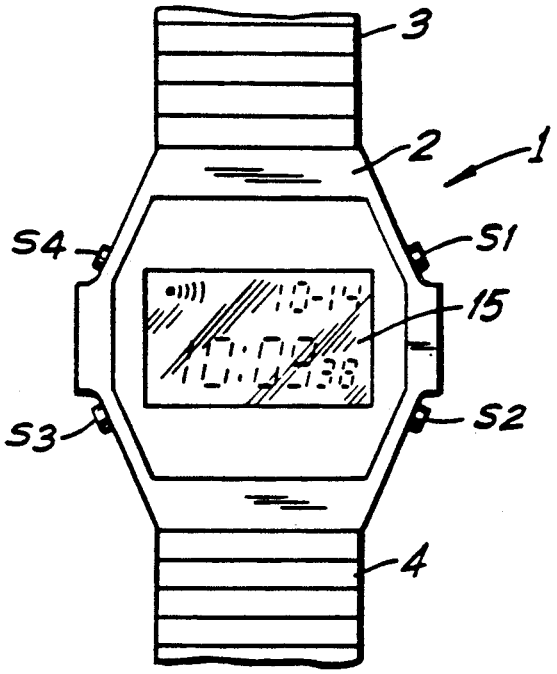
PRIOR ART FIG.1
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes 4 manual push-button actuators S1, S2, S3, S4 arranged to close spring contacts (not shown) inside the watch case 2. An electroptic display 15, which is commonly a liquid crystal display (or LCD) displays digits, letters or other symbols when activated by a microcomputer inside the watch in the form of an integrated circuit.

Figure 2:
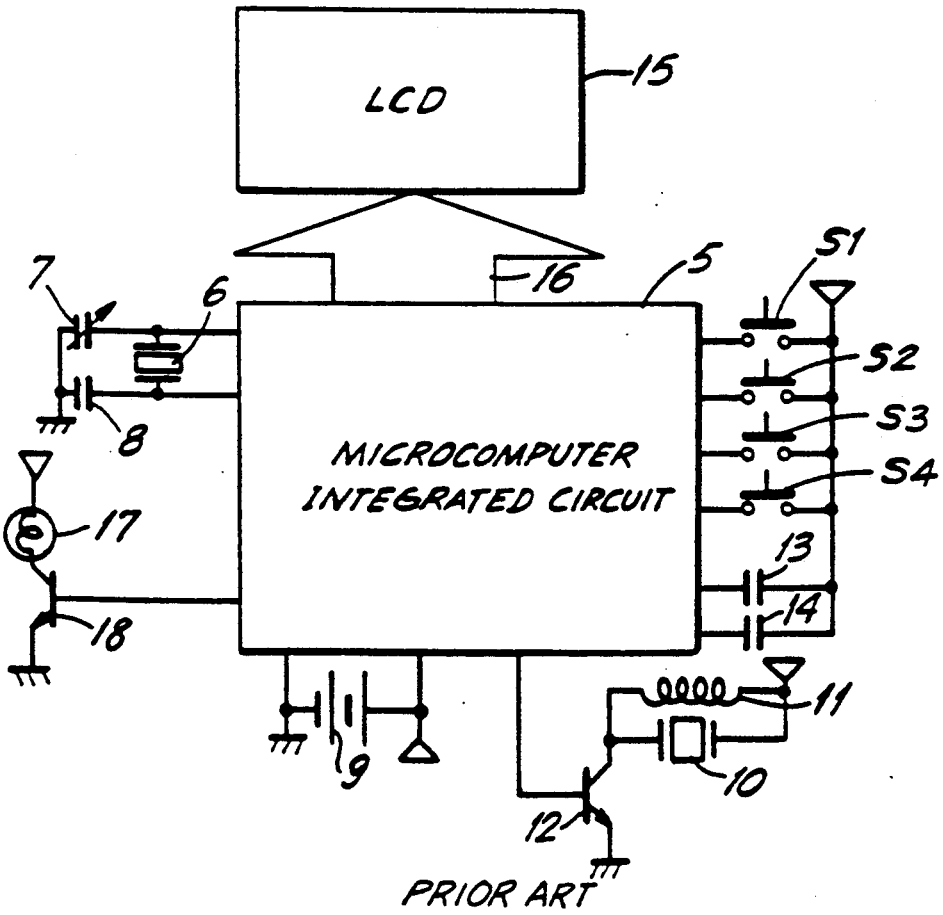
PRIOR ART FIG.2
FIG. 2 is a block diagram of a circuit for the wristwatch of FIG. 1, together with external components such as lamp, switches and display.

Referring to FIG. 2 of the drawing, a schematic block diagram of the electrical connections is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. The microcomputer includes a microprocessor, operating system program for carrying out instructions, and memory locations. A quartz crystal 6 connected in circuit with capacitor 7 and 8 and connected to the oscillator pins of the integrated circuit 5 provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors 13, 14 combined with other circuit elements combined inside the integrated circuit 5 serve to boost the output voltage to drive LCD 15 through a display bus 16, which represents the several parallel leads connected to the various actuatable segments of the LCD display 15 (also shown in FIG. 1). Display 15 is arranged in close proximity with, so as to be illuminated by, a lamp 17 when the lamp is lit by a switching signal from integrated circuit 5 applied to the base of switching transistor 18.

Figure 3:
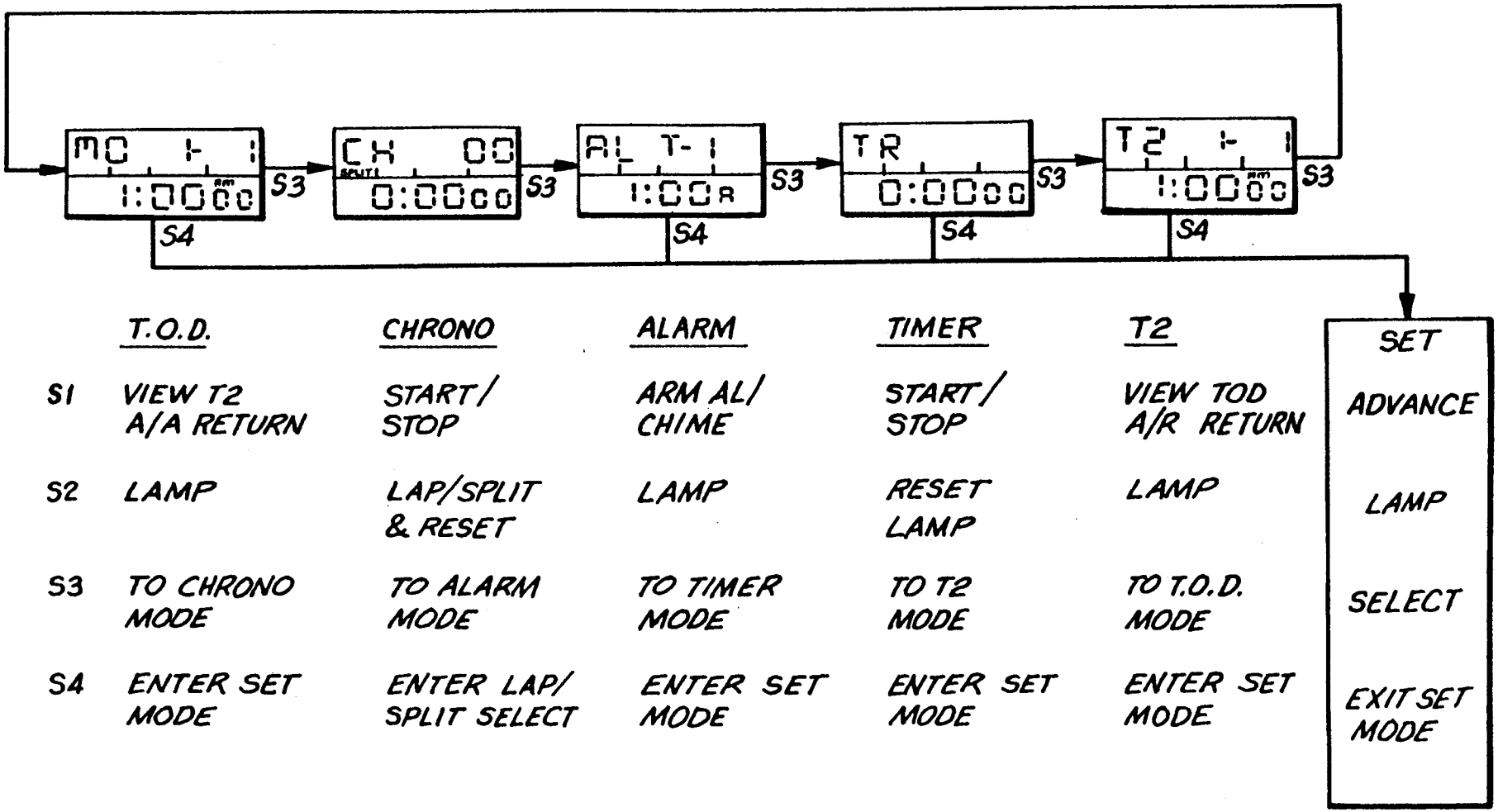
FIG. 3 is a block diagram of a multimode wristwatch illustrating sequence of states in response to manually actuated switches.

Referring now to FIG. 3 of the drawing, a block diagram of a multimode wristwatch illustrates the sequence of modes or states in response to manually actuating switches S1–S4 in accordance with the table. Each of the blocks illustrates the appearance of the display at start-up for the modes illustrated. Beneath each of the display blocks is a column illustrating what happens when the respective switches S1–S4 are actuated while in that mode. The modes for this particular timepiece are time-of-day (TOD), chronograph (CHRONO), alarm setting (ALARM), elapsed time (TIMER), alternate time zone (T2). As indicated in the row opposite switch S3, the program is arranged to shift modes sequentially in a continuous ring. Once in one of the five modes illustrated, actuation of switch S4 sets up a subroutine SET for changing the information displayed. Switch S3 will SELECT a particular piece of information which is indicated on the display by "flashing" the indicia for that piece of information, and switch S1 will ADVANCE the selected bit of information. The operation illustrated in FIG. 3 is well known in the art.

Figure 4:
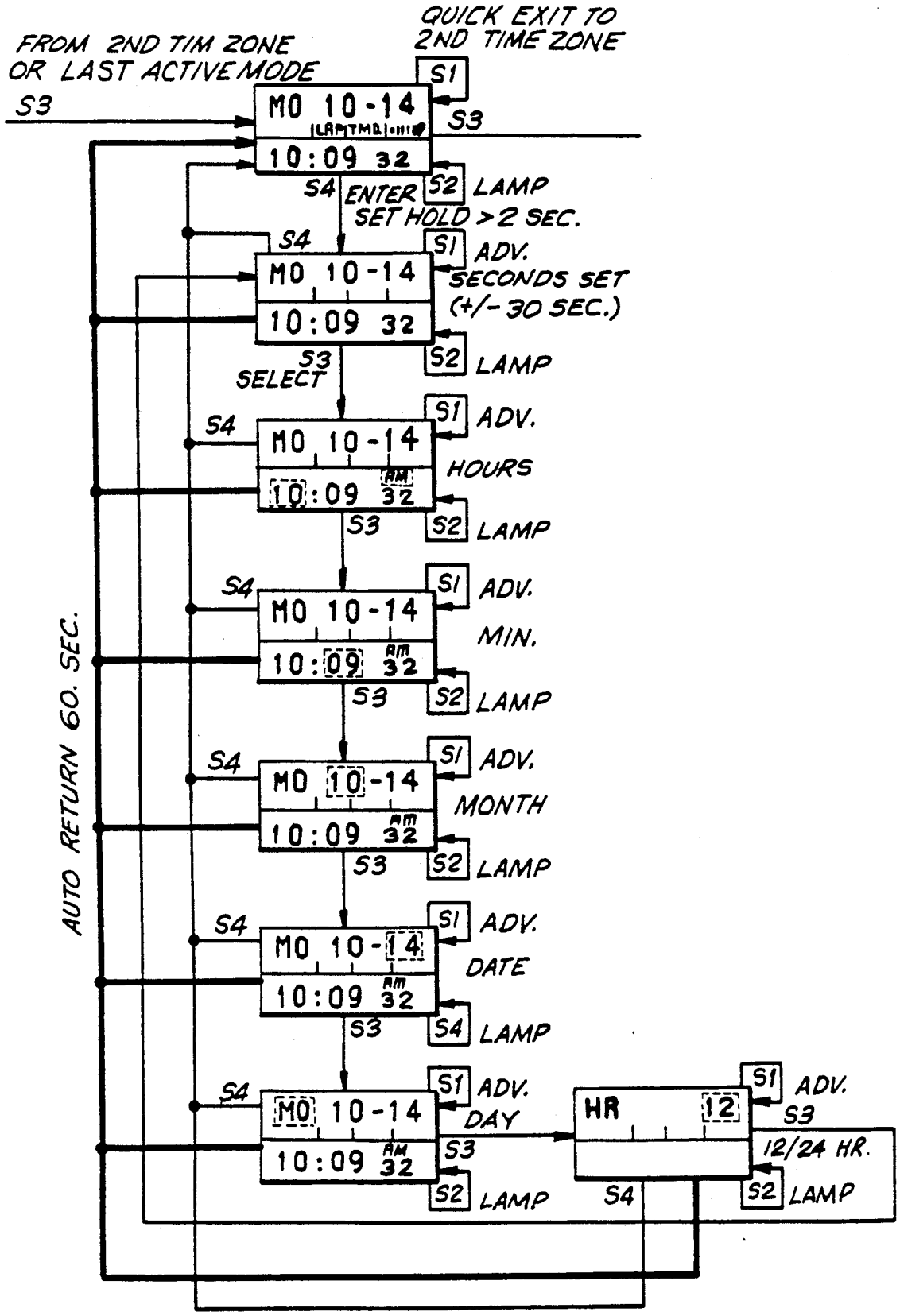
FIG. 4 is a detailed state diagram of time-of-day mode.
Figure 5:
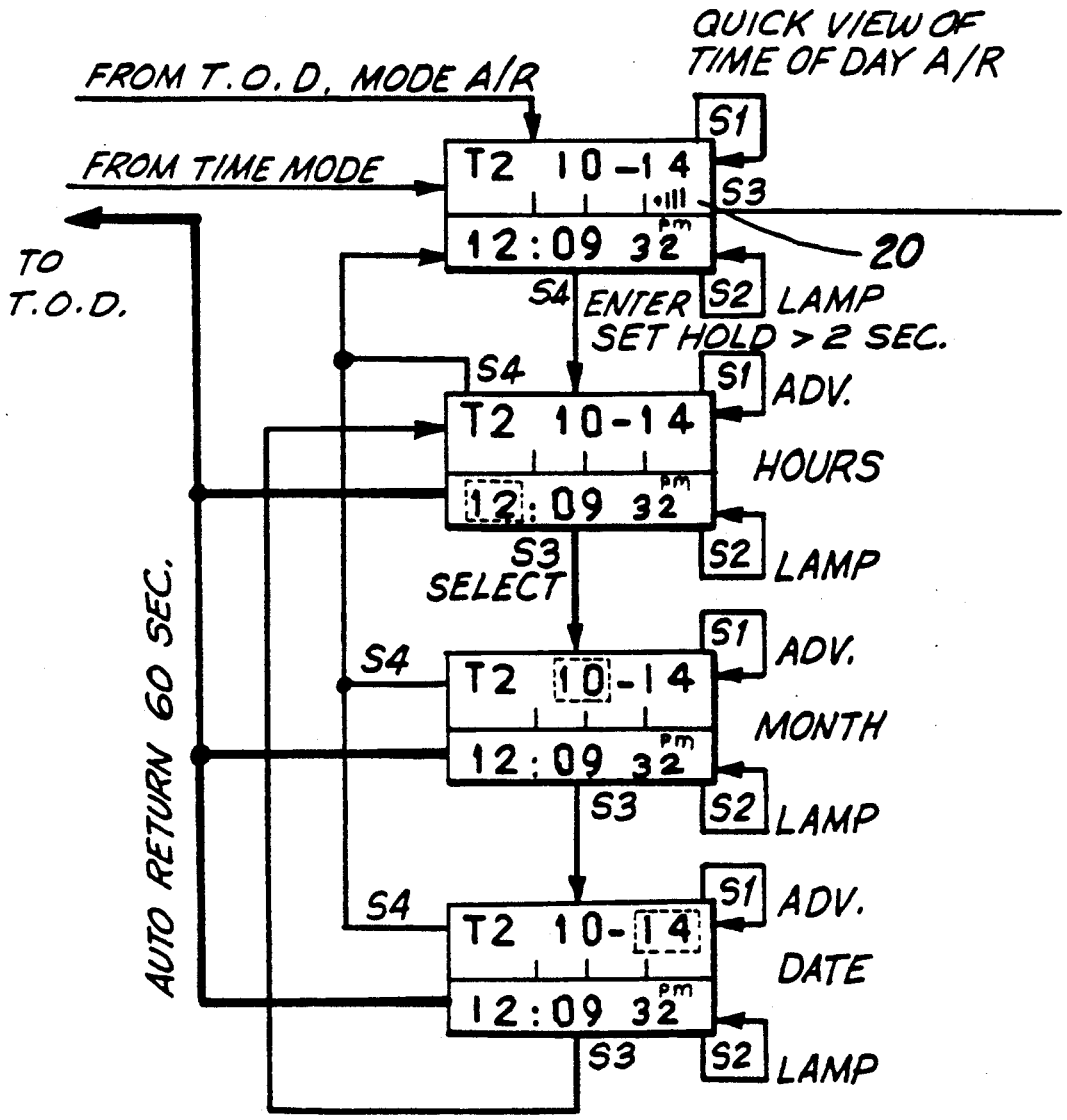
FIG. 5 is a detailed state diagram of alternate time zone mode.
Figure 6:
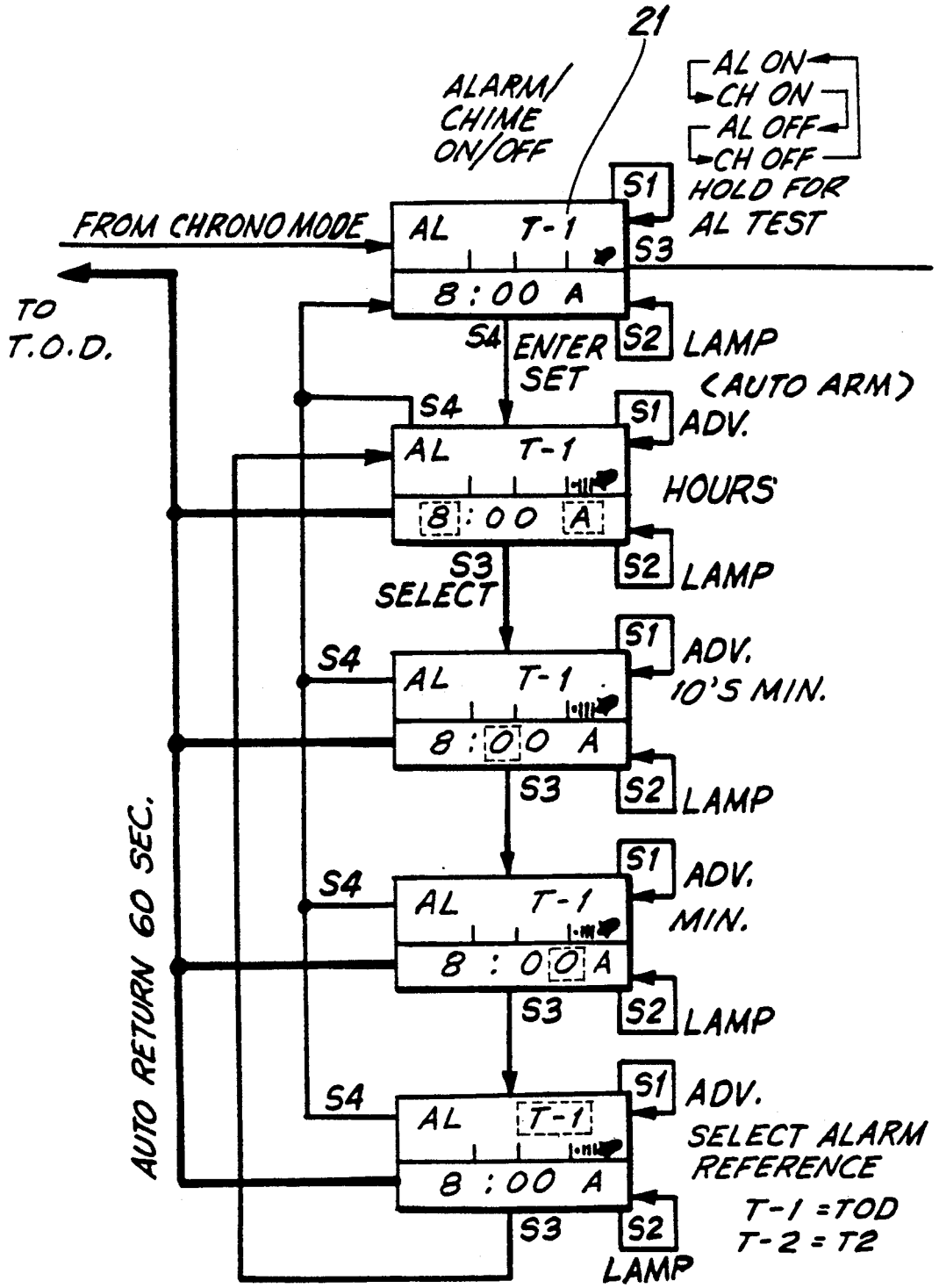
FIG. 6 is a detailed state diagram of alarm setting mode.

Referring now to FIG. 4 through 6 of the drawing, "state" diagrams are shown in schematic form, for time-of-day setting, alternate time zone setting and alarm setting, respectively. Each of the top rectangles describes the type of display shown on the electroptical display 15 when the instrument is in that state. The large rectangles represent a state in which change of displayed information may be controlled by the operator. The dotted rectangle indicates which part of the displayed information will be changed when the S1 switch is actuated. The instrument continues to keep time and to operate under control of the particular subroutine of the program in the microcomputer chip until the instrument is placed into another state. Manipulation of the electronic wristwatch to illuminate the display and carry out the various functions and capabilities is by selective actuation of the manually actuated switches S1–S4. The well known programming technique for determining whether the switches are opened or closed and taking appropriate action is through the operating system computer program stored in the microcomputer memory, in which each switch condition is tested during each complete interrogation cycle in a loop. If any switch is closed, the program branches to a subroutine which initiates a counter. The counter determines how long the switch has been closed or, if the watch has entered another "state" how long it has been in that "state".

Reference to FIG. 4 illustrates the detailed state diagram of the time-of-day mode. This is the basic time-keeping function of the timepiece and illustrates the general method of setting time-of-day. The integrated circuit is programmed to set time-of-day in response to actuation of selected switches in a known manner. Once the set mode is entered from the top block by pressing switch S4 for more than two seconds, a sequence is initiated by which a bit of information to be corrected may be selected by pressing switch S3 successively. For example, in the fourth block down, the "minutes" are selected for correction which is indicated in the drawing by a dotted rectangle around the "09". In an actual watch display, the "09" would flash off and on while the remaining digits remained on. Subsequent actuation of switch S1 will advance the minutes to a new setting.

Reference to FIG. 5 illustrates the alternate time zone mode setting sequence. The integrated circuit is programmed to set alternate time zone time in response to actuation to selected switches. Once the setting sequence is entered by pressing switch S4 and holding it for more than two seconds, the hours, month and date may be selected and corrected by the user. It is unnecessary to select minutes and seconds, because these correspond to the local TOD minutes and seconds. It should be noted that, in accordance with the present invention, there is an actuatable indicia such as an icon or flag symbol indicated by reference numeral 20. This alarm icon will only appear in the alternate time zone display if the alarm is "armed" and in addition only if the alarm is with referenced to the alternate time zone in a manner which will be explained. Reference to FIG. 6 of the drawing illustrates the alarm mode setting sequence. The alarm may be armed by actuating switch S1. The alarm set time may be set in response to actuation of switch S4 and then actuating additional selected switches as previously described. This procedure causes a memory location to locate the address of, or point to, time-of-day when carrying out the well-known procedure of comparing alarm set time to time-of-day and then actuating an audible alarm device when the two times coincide.

In accordance with the present invention, the alarm display includes an additional actuatable segment 21, which may causes the display to read either T-1 or T 2, herein known as the alarm reference. T-1 indicates that the alarm set time will be compared to local time-of-day. Alarm reference T-2 indicates that the alarm set time will be compared to the alternate time zone.

As indicated in the bottom display block on FIG. 6, the alarm reference T-1 will flash when selected and may be advanced (toggled) between T-1 and T-2.

In accordance with the present invention, flag means are provided by means of which a flag bit can be set in a memory location by actuating a manual switch. The program checks the condition of the flag bit and alters the program operation accordingly. When the selected alarm reference is T-1, the flag bit is set in one condition. On the other hand, when the selected alarm reference is T-2, the flag bit is set in a different condition in the integrated circuit memory. The operating program of the timepiece is arranged in a manner well known to those skilled in the art to check the condition of the T-1/T-2 flag bit on a continuing cyclical basis. The program is further arranged in a manner well known to those skilled in the art to direct the sequence of operations either to local time-of-day or to alternate time zone time in accordance with the condition of the flag bit, so as to compare the alarm set time either with the local time-of-day or with the alternate time zone time, depending upon the condition of the flag bit. In this manner, provided that the alarm is armed, the audible alarm device will be actuated in one case when the alarm set time corresponds with the local time of-day and in the other case when the alarm time setting corresponds with the alternate time zone time.

Selection of the alarm reference and setting the flag bit is carried out by actuating switch S2 as shown in the lower right hand corner of FIG. 6. This causes the selected alarm reference to be displayed with the segment 21. Selection of T-2 further causes the icon 21 to appear on the display of the alternate time zone illustrated in FIG. 5, provided that the alarm is also armed.

The term "state" and "mode" are used interchangeably herein and not intended by way of limitation.

While there has been described what is considered to be the preferred embodiment of the invention, other modifications will become known to those skilled in the art, and it is desired to cover in the appended claims all such modifications as fall within the true spirit and scope of the invention.

I claim:

1. In a multimode electronic timepiece having a display, an audible alarm device, a plurality of manually actuated switches, and an integrated circuit programmed to keep time and to provide a plurality of modes, including time-of-day, alternate time zone and alarm setting modes, said integrated circuit also being programmed to permit an operator to set time-of-day in response to actuation of selected switches, to set alternate time zone time in response to actuation of selected switches and to set alarm set time in an alarm setting mode in response to actuation of selected switches, said integrated circuit having a memory location for storing time-of-day and being programmed to selectively actuate said audible alarm device when said alarm set time corresponds to time-of-day in said memory location, the improvement comprising:

flag means selected in response to actuation of one of said switches while in said alarm setting mode adapted to select either said alternate time zone time or time-of-day, whereby said audible alarm device may be actuated when the alarm set time corresponds either to time-of-day or to alternate time zone in response to setting of said flag means.

2. The improvement according to claim 1, wherein said alarm setting mode is adapted to display a first indicia indicating the condition of said flag means.

3. The improvement according to claim 1, wherein the alarm setting mode is adapted to arm the alarm in response to acuation of a selected switch so that the audible alarm device is actuated when alarm set time corresponds to time-of-day or alternate time zone time in response to setting of said flag means.

4. The improvement according to claim 3, wherein said alternate time zone mode is adapted to display second indicia when said alarm is armed at the same time that said flag means is referenced to said alternate time zone.

* * * * *